US007066396B2

(12) United States Patent
Knight et al.

(10) Patent No.: US 7,066,396 B2
(45) Date of Patent: Jun. 27, 2006

(54) METHOD AND APPARATUS FOR ENHANCED HEAT RECOVERY FROM STEAM GENERATORS AND WATER HEATERS

(75) Inventors: Richard A. Knight, Brookfield, IL (US); Iosif K. Rabovitser, Skokie, IL (US); Dexin Wang, Indian Creek, IL (US)

(73) Assignee: Gas Technology Institute, Des Plaines, IL (US)

( * ) Notice: Subject to any disclaimer, the term of this patent is extended or adjusted under 35 U.S.C. 154(b) by 43 days.

(21) Appl. No.: 10/961,438

(22) Filed: Oct. 8, 2004

(65) Prior Publication Data

US 2006/0076428 A1 Apr. 13, 2006

(51) Int. Cl.
*B60H 1/02* (2006.01)

(52) U.S. Cl. ..... 237/19; 237/16

(58) Field of Classification Search ..... 237/16, 237/19, 7, 8 R, 8 A, 9 R
See application file for complete search history.

(56) References Cited

U.S. PATENT DOCUMENTS 3,735,559 A 5/1973 Salemme
3,770,196 A * 11/1973 Griffith et al. ..... 237/9 R
3,834,355 A * 9/1974 Arant ..... 122/33
3,964,416 A * 6/1976 Kiraly et al. ..... 114/20.2
3,980,605 A 9/1976 Steigelmann et al.
4,295,606 A * 10/1981 Swenson ..... 237/12.1
4,358,052 A * 11/1982 Leinenbach ..... 237/8 R
4,466,202 A 8/1984 Merten
4,479,605 A * 10/1984 Billotte et al. ..... 237/8 R
4,583,996 A 4/1986 Sakata et al.
4,587,401 A * 5/1986 Ekman ..... 392/495
4,706,884 A * 11/1987 Brauer ..... 237/55
4,823,770 A * 4/1989 Loeffler ..... 122/15.1
4,875,908 A 10/1989 Kikukawa et al.
4,896,508 A * 1/1990 Reinke, Jr. ..... 60/648
5,071,451 A 12/1991 Wijmans
5,236,474 A 8/1993 Schofield et al.
6,053,418 A * 4/2000 Guyer ..... 237/12.1

* cited by examiner

*Primary Examiner*—Derek S. Boles
(74) *Attorney, Agent, or Firm*—Mark E. Fejer

(57) ABSTRACT

A heating system having a steam generator or water heater, at least one economizer, at least one condenser and at least one oxidant heater arranged in a manner so as to reduce the temperature and humidity of the exhaust gas (flue gas) stream and recover a major portion of the associated sensible and latent heat. The recovered heat is returned to the steam generator or water heater so as to increase the quantity of steam generated or water heated per quantity of fuel consumed. In addition, a portion of the water vapor produced by combustion of fuel is reclaimed for use as feed water, thereby reducing the make-up water requirement for the system.

13 Claims, 7 Drawing Sheets

METHOD AND APPARATUS FOR ENHANCED HEAT RECOVERY FROM STEAM GENERATORS AND WATER HEATERS

The U.S. Government has a paid-up license in this invention and the right in limited circumstances to require the patent owner to license others on reasonable terms as provided for by the terms of contract No. DE-FC36-00ID13904 awarded by the U.S. Department of Energy.

BACKGROUND OF THE INVENTION

1. Field of the Invention

This invention relates to steam generators and water heaters, also referred to herein as steam boilers and hot water boilers. More particularly, this invention relates to space-efficient steam generators and water heaters having improved energy efficiency over conventional steam generators and water heaters. The improved energy efficiency is achieved by recovering both the sensible and latent heat of vaporization from moisture in the flue gases and returning the recovered energy to the steam generator or water heater. In addition to the energy efficient steam generators and water heaters, this invention relates to space-efficient steam generators and water heaters having reduced $NO_x$ emissions over conventional steam generators and water heaters.

2. Description of Related Art

Many industrial processes produce process streams containing condensable components such as water vapor. As the mere discarding of these condensable components can constitute a substantial loss in available heat energy, it is desirable to recover these condensable components from the process streams for economic reasons. It is also desirable to recover the latent heat of vaporization associated with such condensable components as a means for reducing process energy requirements. The use of heat exchanger-based condensers for the recovery of condensable components of process streams and the latent heat of vaporization associated therewith is well known to those skilled in the art.

Methods and apparatuses for the selective removal of one or more components from a gaseous mixture are well known. U.S. Pat. No. 4,875,908 teaches a process for selectively separating water vapor from a multi-component gaseous mixture in which the multi-component gaseous mixture comprising the water vapor is passed along and in contact with a membrane which is selectively permeable to water vapor. The use of membranes for selective removal of one or more components of a gaseous mixture is also taught by U.S. Pat. No. 4,583,996 (inorganic porous membrane), U.S. Pat. No. 3,980,605 (fibrous semi-permeable membrane) and U.S. Pat. No. 3,735,559 (sulfonated polyxylylene oxide membranes).

Methods and apparatuses for selective removal of water vapor from a gaseous mixture and condensing the separated water vapor to recover its latent heat of vaporization are also known. U.S. Pat. No. 5,236,474 and related European Patent Application 0 532 368 teach a process for removing and recovering a condensable vapor from a gas stream by a membrane contactor in which a gas stream containing a condensable vapor is circulated on one side of hollow fiber membranes while cool extraction fluid is circulated on the other side under a total pressure differential. As a result, the condensable vapor in the gas stream is condensed in the gas stream and the condensed vapor, i.e. liquid, permeates the membrane and becomes entrained in the cool extraction fluid.

U.S. Pat. No. 4,466,202 teaches a process for recovery and reuse of heat contained in the wet exhaust gases emanating from a solids dryer or liquor concentrator by preferentially passing the vapor through a semi-permeable membrane, compressing the water or solvent vapor, and subsequently condensing the water or soluble vapor in a heat exchanger, thereby permitting recovery of its latent heat of vaporization for reuse in the evaporation process. It will be apparent to those skilled in the art that a substantial amount of energy will be required to compress the water or solvent vapor in accordance with the process of this patent. U.S. Pat. No. 5,071,451 teaches a vapor recovery system and process that permits condenser vent gas to be recirculated. The system includes a small auxiliary membrane module or set of modules installed across a pump and condenser on the downstream side of a main membrane unit, which module takes as its feed the vent gas from the condenser and returns a vapor-enriched stream upstream of the pump and condenser.

FIGS. 1 and 2 exemplify state-of-the-art heat recovery systems for removing moisture from flue gases by direct condensation in which a portion of the condensate is evaporated into the combustion air until it is nearly saturated. As shown in FIG. 1, the flue gases are cooled by a direct water spray in a condenser-scrubber. A portion of the condensate is discarded through a drain and the remaining portion is pumped to a humidifying air heater where it is sprayed into the combustion air, thereby heating and humidifying the combustion air to increase its dew point as well as its total enthalpy, resulting in a higher dew point flue gas so that more water vapor can be condensed in the condensing boiler. The cooled excess condensate is then recycled to the condenser-scrubber. Once a steady state is established, the discarded condensate is equal to the amount of water condensed from the flue gases.

As shown in FIG. 2, the condenser and humidifying air heater are integrated into a single device, where the cool combustion air removes heat from the flue gases, causing moisture to condense on the outer surface of a porous membrane. The moisture permeates through the membrane and evaporates into the combustion air, raising its dew point and increasing the inventory of moisture in the system, thereby allowing more heat to be removed. Although simpler than the system shown in FIG. 1, this method does not allow as much control over the condensation and evaporation rates. In addition, as in the system shown in FIG. 1, all of the condensed water is ultimately discarded.

SUMMARY OF THE INVENTION

It is, thus, one object of this invention to provide a method and system for improving the energy efficiency of conventional steam generators and water heaters by eliminating the condensate drain employed in conventional systems and methods and utilizing all of the condensate in the steam generator or water heater.

This and other objects of this invention are addressed by a heating system comprising a steam generator or water heater, at least one economizer, at least one condenser and at least one oxidant heater arranged in a manner so as to reduce the temperature and humidity of the exhaust gas (flue gas) stream and recover a major portion of the associated sensible and latent heat. The recovered heat is returned to the steam generator or water heater so as to increase the quantity of steam generated or water heated per quantity of fuel consumed. In addition, a portion of the water vapor produced by combustion of the fuel is reclaimed for use as feed water, thereby reducing the make-up water requirement for the system.

More particularly, the heating system of this invention comprises a fluid heater vessel having a fuel inlet, an oxidant inlet and flue gas exhaust means for exhausting flue gases from the fluid heater. The flue gas exhaust means comprises a first economizer section disposed downstream of the fluid heater and a condenser section disposed downstream of the first economizer section, which condenser section includes at least one condensate outlet. The system further comprises an oxidant preheater having an ambient oxidant inlet and a heated oxidant outlet, which heated oxidant outlet is in fluid communication with the oxidant inlet of the fluid heater vessel. A first fluid heat exchange means for heating a fluid is disposed in thermal communication with the fluid heater vessel; a second fluid heat exchange means for heating a fluid is disposed in thermal communication with the first economizer section and a third fluid heat exchange means for heating a fluid is disposed in thermal communication with the oxidant preheater. The system further comprises condenser means for condensing flue gas water vapor, which condenser means are disposed within the condenser section. Also included in the system of this invention is a de-aerator vessel and fluid communication means for providing fluid communication from the condenser means into the third fluid heat exchange means, from the condensate outlet into the third fluid heat exchange means, from the third fluid heat exchange means into the condenser means, from the condenser outlet and the condenser means into the de-aerator vessel, from the de-aerator vessel into the second fluid heat exchange means, from the second fluid heat exchange means into the first fluid heat exchange means, and from the first fluid heat exchange means into the or de-aerator vessel. It should be noted that, particularly in smaller boilers, a feed water tank heated with steam may be employed in place of a de-aerator, and the use of feed water tanks in place of de-aerators is deemed to be within the scope of this invention.

BRIEF DESCRIPTION OF THE DRAWINGS

These and other objects and features of this invention will be better understood from the following detailed description taken in conjunction with the drawings wherein.

DETAILED DESCRIPTION OF THE PRESENTLY PREFERRED EMBODIMENTS

As used herein, the term "fluid heater" refers to either a steam generator or water heater and the term "boiler" refers to either a steam generator or water heater using the traditional terminology employed in the industry, i.e. "steam boiler" or "hot water boiler". Likewise, the term "boiler feed water" is used in reference to water introduced into the "boiler".

Figure 1:
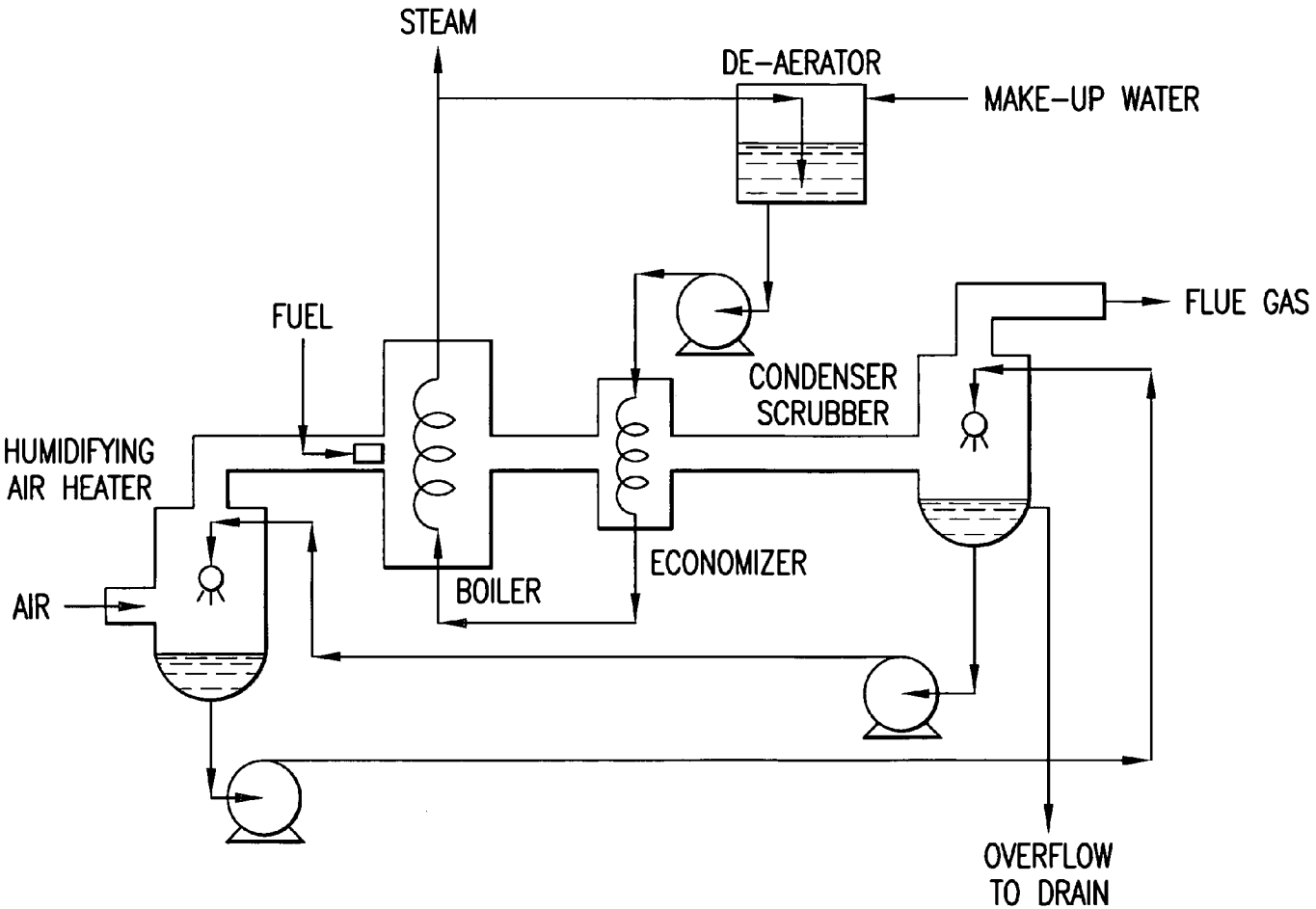
FIG. 1 (Prior Art)
FIG. 1 is a schematic diagram of one embodiment of a typical state-of-the-art steam generator system.
Figure 2:
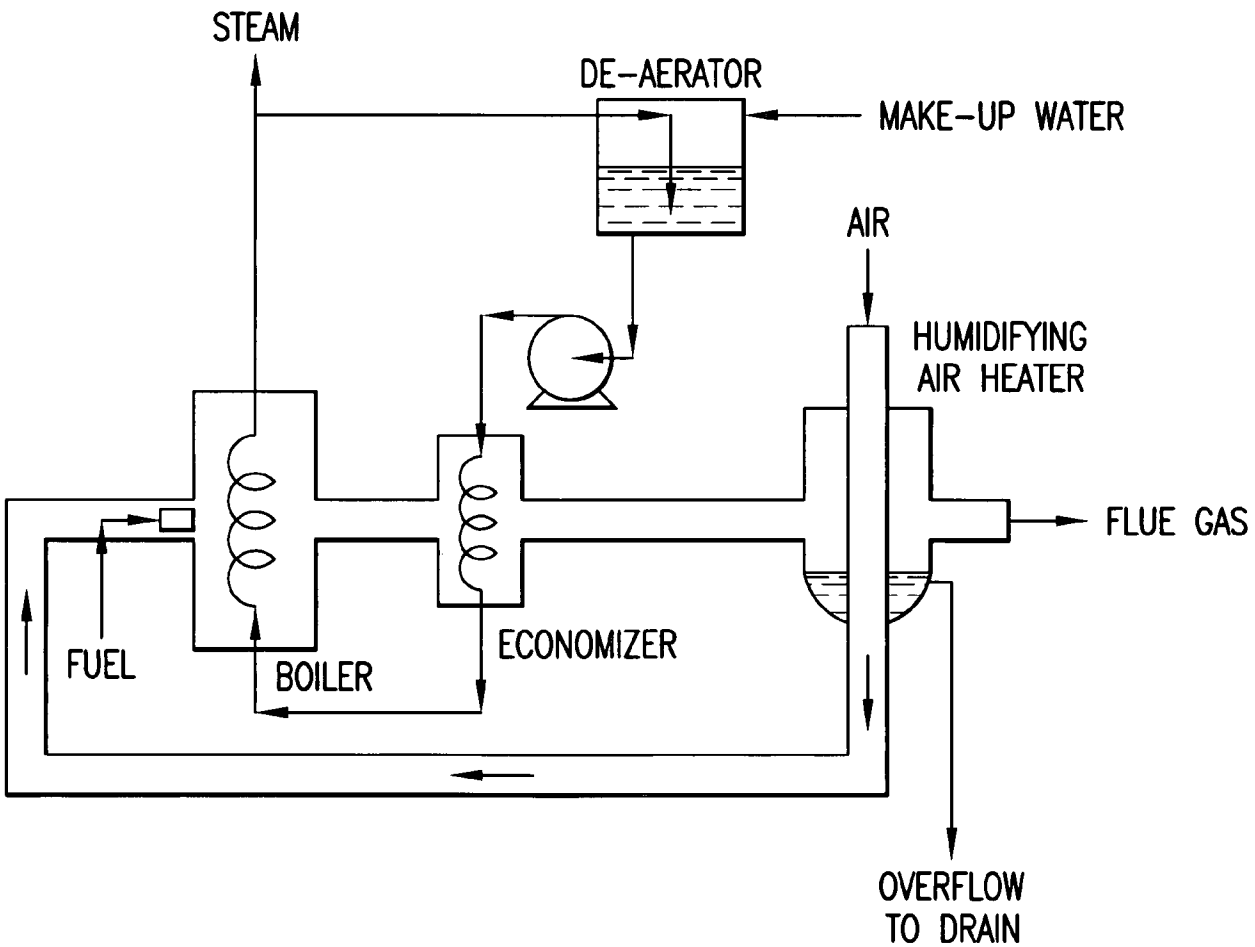
FIG. 2 (Prior Art)
FIG. 2 is a schematic diagram of a second embodiment of the state-of-the-art steam generator system of FIG. 1.
Figure 3:
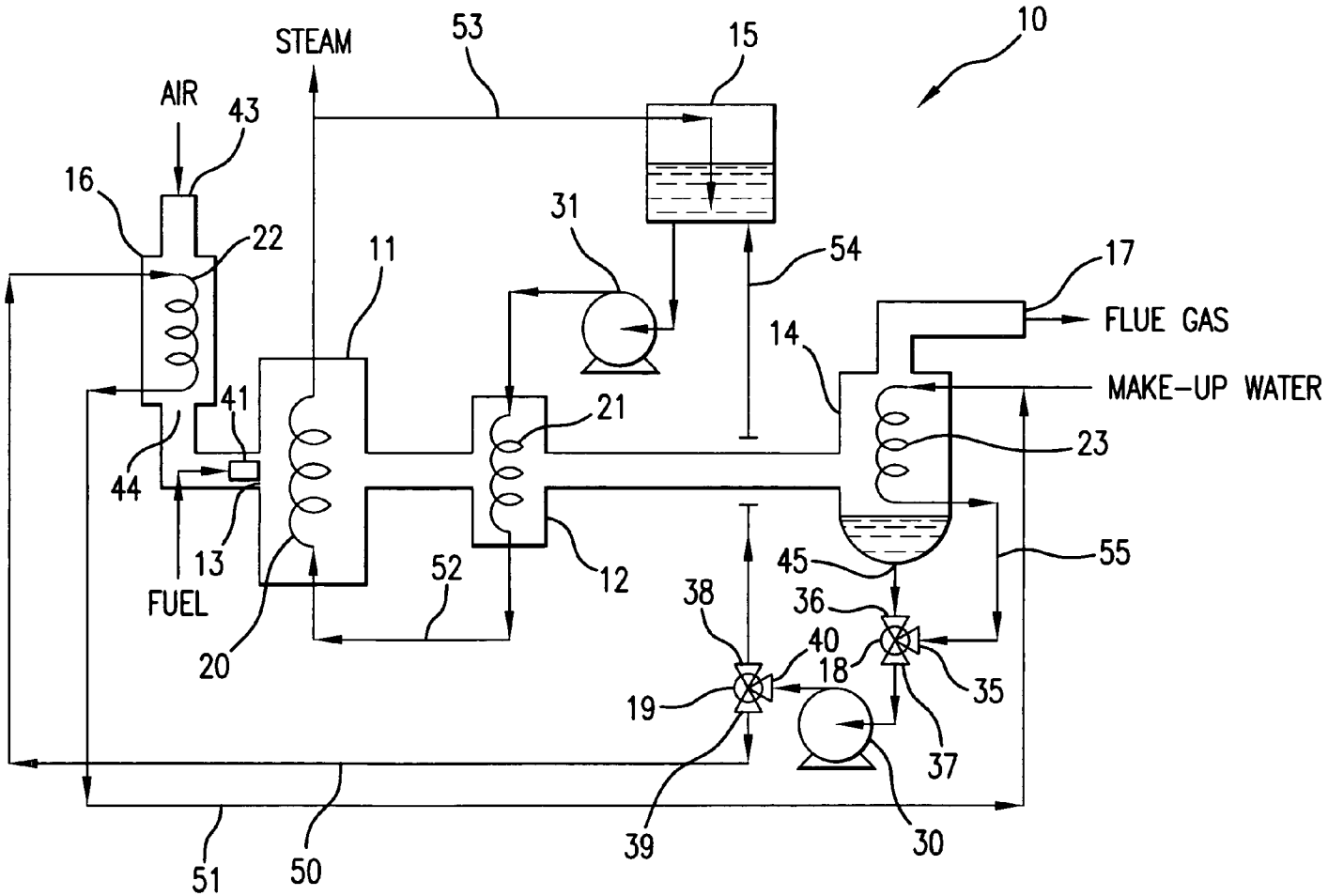
FIG. 3 is a schematic diagram of a steam generator system in accordance with one embodiment of this invention.

The invention disclosed herein is a heating system and method for heating. FIG. 3 shows one embodiment of the heating system of this invention. As shown therein, heating system 10 comprises a fluid heater vessel 11 having a fuel and oxidant inlet 13 and flue gas exhaust means for exhausting flue gases from the fluid heater. Fuel is introduced into fluid heater vessel 11 by means of burner 41 and oxidant, typically air, is provided to fluid heater vessel 11 by means of an oxidant preheater 16 having an ambient oxidant inlet 43 and a heated oxidant outlet 44. Heated oxidant outlet 44 is in fluid communication with fuel and oxidant inlet 13. The flue gas exhaust means for exhausting flue gases from the fluid heater vessel comprises a first economizer section 12 disposed downstream of fluid heater vessel 11 and a condenser section 14 disposed downstream of the first economizer section 12 and having a condensate outlet 45.

Figure 4:
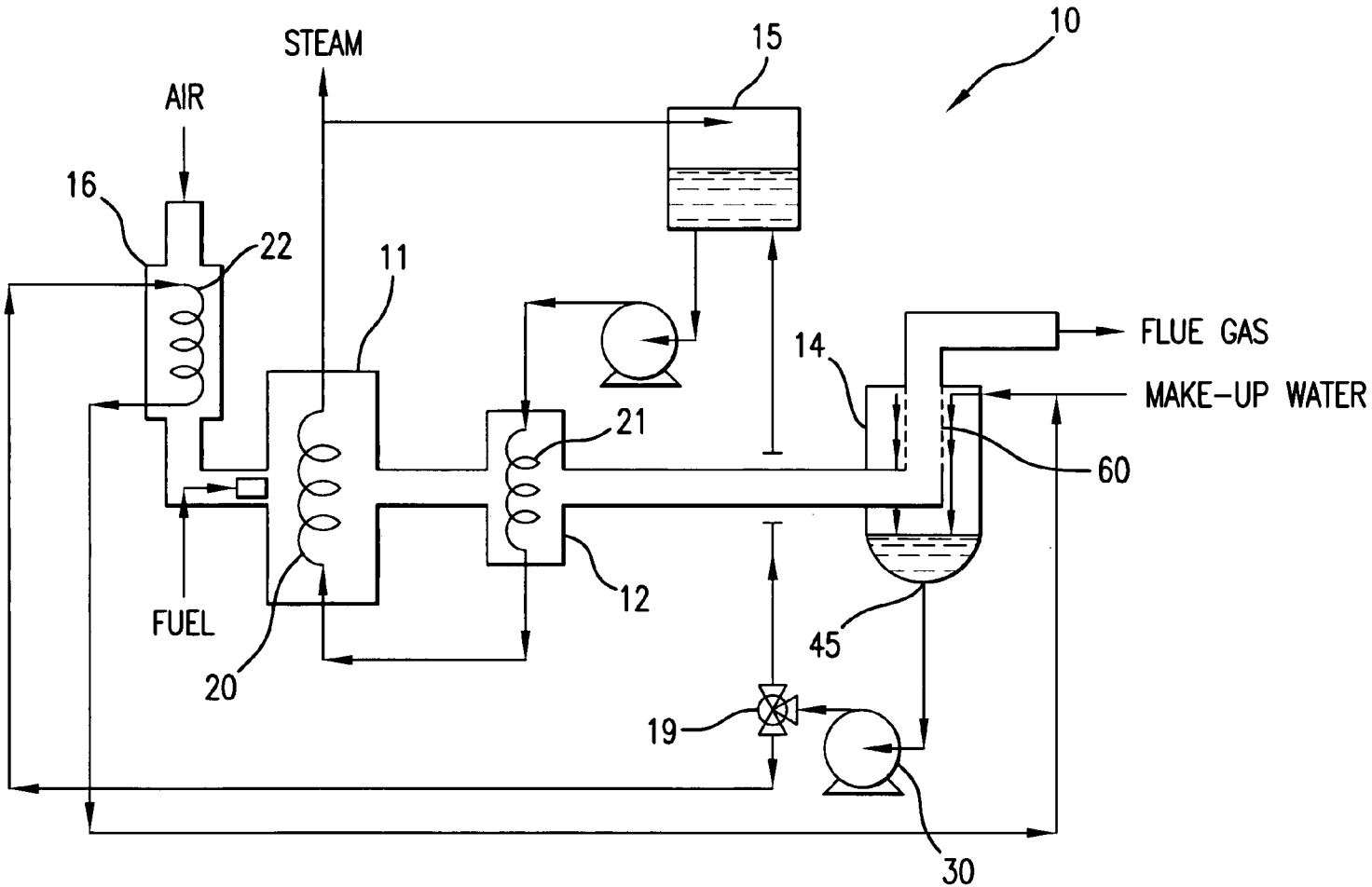
FIG. 4 is a schematic diagram of a steam generator system in accordance with another embodiment of this invention.

Disposed in thermal communication with fluid heater vessel 111 is a first fluid heat exchange means 20, typically in the form of a conduit through which a heat exchange fluid is flowing, which fluid heat exchange means in combination with the fluid heater vessel constitutes a conventional boiler. In the instant case, the heat exchange fluid is water from which steam is produced. A second fluid heat exchange means 21 is disposed in thermal communication with first economizer section 12 and a third fluid heat exchange means 22 is disposed in thermal communication with oxidant preheater 16. Disposed within condenser section 14 is condenser means for condensing flue gas water vapor. In the embodiment shown in FIG. 3, the condenser means comprises a direct surface condenser in the form of a coiled conduit 23. In accordance with one particularly preferred embodiment of this invention discussed in more detail herein below, the condenser means comprises at least one separation membrane element 60, as shown in FIG. 4, whereby water vapor present in the flue gases flowing through condenser section 14 condenses within and passes through the membrane directly into the volume defined by the condenser section shell in which it mixes with make-up water also being introduced into the condenser section. To prevent other components of the flue gases from passing through the membrane, separation membrane element 60 preferably comprises a permselective membrane which selectively permits substantially only water vapor and water to pass through.

As shown in FIG. 3, the system of this invention further comprises fluid communication means for providing fluid communication from the condenser means 23 into the third fluid heat exchange means 22 (lines 55 and 50), from the condensate outlet 45 into the third fluid heat exchange means 22 (also line 50), from the third fluid heat exchange means 22 into the condenser means 23 (line 51), from the condensate outlet 45 and the condenser means 23 into feed water tank or de-aerator vessel 15 (line 54), from feed water tank or de-aerator vessel 15 into the second fluid heat exchange means 21, from the second fluid heat exchange means 21 into the first fluid heat exchange means 20 (line 52), and from the first fluid heat exchange means 20 into the feed water tank or de-aerator vessel 15 (line 53).

In normal operation, fuel and oxidant are burned by means of burner 41 in fluid heater vessel 11, and a portion of the released heat is transferred by way of first fluid heat exchange means 20 through which a boiler feed water stream is flowing, heating the boiler feed water and converting at least a portion thereof to steam. The flue gases exiting fluid heater vessel 11 pass into first economizer section 12 of the flue gas exhaust means in which the flue gases are cooled by contact with second fluid heat exchange means 21, thereby transferring a portion of its sensible heat to the boiler feed water stream flowing through second fluid heat exchange means 21. The cooler flue gases exiting first economizer section 12 pass into condenser section 14 of the flue gas exhaust means in which additional cooling of the flue gases occurs, resulting in condensing of the water vapor present in the flue gases. The condensed water, i.e. condensate, is collected in condenser section 14 from which it passes through condensate outlet 45 and into mixing valve 18. Mixing valve 18 comprises condensate inlet 36, a heated boiler feed water/make-up water inlet 35 and a mixed water outlet 37. It is to be understood by those skilled in the art that mixing valve 18 could be replaced with two variable-flow valves appropriately disposed and controlled, and the use of such variable-flow valves is deemed to be within the scope of this invention. The mixture of condensate, heated boiler feed water and make-up water is routed to pump 30 by which its pressure is increased. The pressurized water is then routed through proportioning valve inlet 40 of proportioning valve 19 which distributes a first portion thereof through proportioning valve outlet 39 to third fluid heat exchange means 22 disposed in thermal communication with oxidant preheater 16 and a second portion thereof through proportioning valve outlet 38 through line 54 to de-aerator 15 in response to control signals generated by a boiler control system (not shown). It is to be understood by those skilled in the art that proportioning valve 19 could be replaced with two variable-flow valves appropriately disposed and controlled, and the use of such variable-flow valves is deemed to be within the scope of this invention. The water routed to de-aerator 15 is exposed to a portion of the product steam exiting first fluid heat exchange means 20 and passing through line 53 into de-aerator 15, which facilitates the removal of dissolved gases including oxygen and carbon dioxide. The de-aerated water is then routed to pump 31 where it is further pressurized and conveyed through first economizer section 12 and into heat exchange means 20 for steam generation or heating. The portion of water exiting proportioning valve 19 through proportioning valve outlet 39 is directed to oxidant preheater 16 in which a portion of its sensible heat is transferred by way of third fluid heat exchange means 22 to an ambient temperature oxidant stream entering through ambient oxidant inlet 43 into oxidant preheater 16. Thereafter, it is returned through line 51 to a point at which it mixes with make-up water input to condenser element 23.

The principle benefits of the embodiment shown in FIG. 3 compared to conventional systems employing an indirect flue gas-air heater for heat recovery are a) smaller size resulting from the use of gas-liquid heat exchangers instead of gas—gas heat exchangers and b) higher heat transfer rates resulting from the higher heat capacity of water compared to air. The embodiment shown in FIG. 3 is particularly suitable for boilers fueled with a very clean gaseous fuel that does not produce appreciable amounts of oxidized forms of sulfur or nitrogen in the flue gases, which would contaminate the boiler feed water to an unacceptable level.

FIG. 4 shows one preferred embodiment of the heating system of this invention which addresses the problem of fuel related feed water contaminants. As previously indicated, the direct surface condenser, i.e. coiled conduit 23, of the condenser means is replaced by at least one separation membrane element 60 through which the flue gases pass. Separation membrane element 60 comprises at least one permselective membrane across which water vapor present in the flue gases passes to the shell side of separation membrane element 60. This transported water vapor, designated as "permeate", mixes with liquid water obtained from the mixture of make-up water and reclaimed water from oxidant preheater 16, said mixed stream flowing parallel to the membrane surface, preferably in a direction countercurrent to the flow of flue gases. In this manner, unwanted contaminants present in the flue gases are prevented from passing into the feed water. The combined make-up water, water extracted from the flue gases, and recycled water from the oxidant preheater is removed from condenser section 14 through condensate outlet 45 by means of pump 30 and handled as before. In this embodiment, mixing valve 18 employed in the embodiment shown in FIG. 3 is not required and, thus, is removed from the system. By virtue of this embodiment of the system of this invention, the use of industrial grade fuels, which may contain contaminants, is enabled. Corollary benefits of this embodiment include increased thermal efficiency as a consequence of all of the latent heat recovered from the flue gas moisture being used directly in the boiler, the ability to reduce the dew point of the exhausted flue gases because there is no direct contact between the flue gases and the hot condensate following condensation, and reclamation of water from combustion products for use as a portion of the boiler feed water, thereby reducing make-up water requirements.

Figure 5:
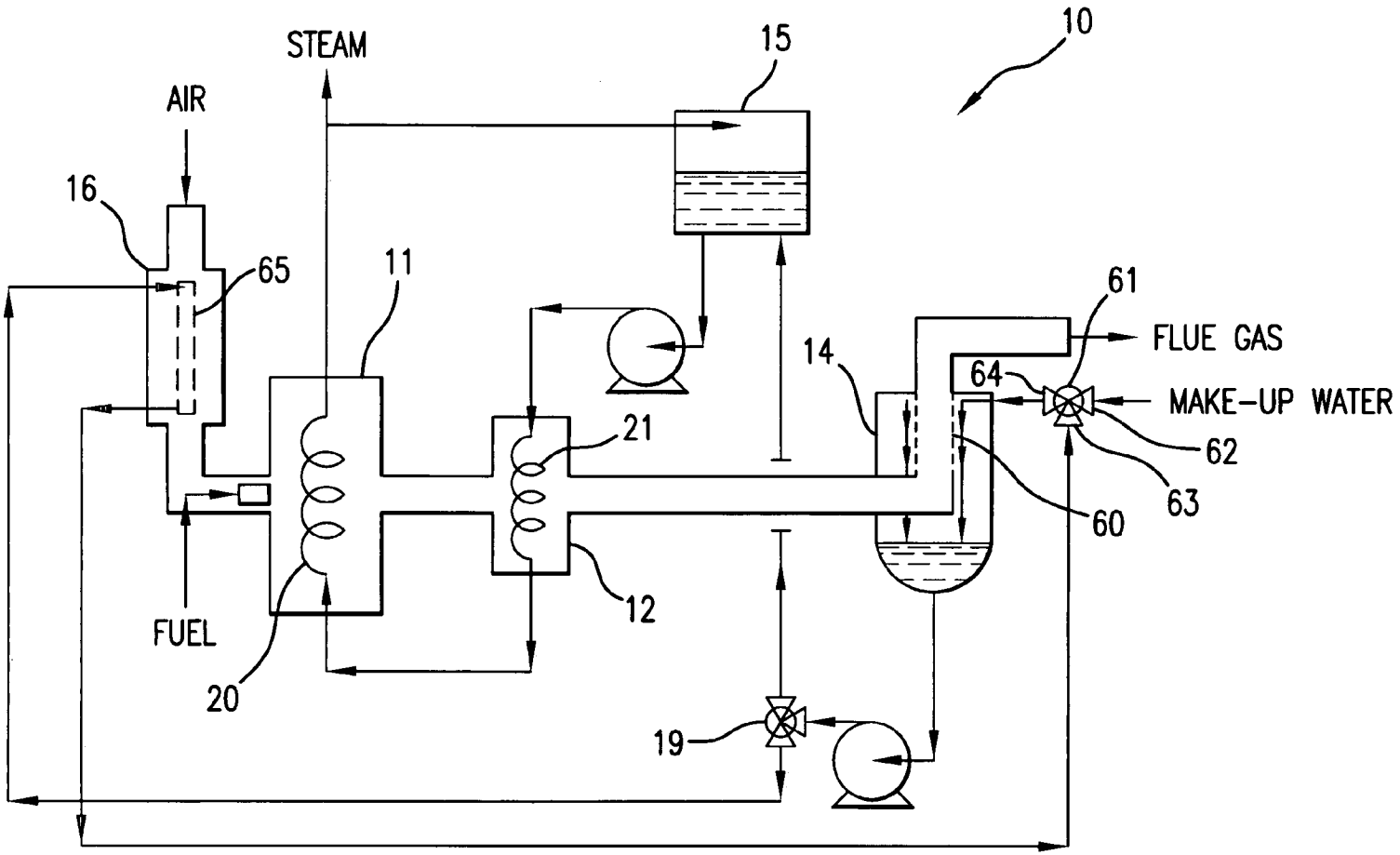
FIG. 5 is a schematic diagram of a steam generator system in accordance with yet another embodiment of this invention.

Another preferred embodiment of the system of this invention is shown in FIG. 5 in which the third fluid heat exchange means 22 (FIG. 3) disposed in thermal communication with oxidant preheater 16 is replaced by one or more humidifying oxidant heater elements 65 whereby a portion of the reclaimed water is transferred together with heat to the combustion oxidant stream. The humidifying oxidant heater element comprises at least one microporous membrane through which water passes at a controlled rate for humidification of the oxidant. To control the water pressure and thereby control the rate of humidification that occurs at oxidant preheater 16, a make-up water proportioning valve 61 having a make-up water inlet 62, a return water inlet 63 and a combined return water/make-up water outlet 64 is provided. It is to be understood by those skilled in the art that proportioning valve 61 could be replaced with two variable-flow valves appropriately disposed and controlled, and the use of such variable-flow valves is deemed to be within the scope of this invention.

One benefit of the embodiment of this invention shown in FIG. 5 is the more effective cooling of a portion of the separation membrane condensate water prior to recycling it back to the separation membrane condenser, which increases the amount of water vapor that can be removed from the flue gases, thereby increasing thermal efficiency. An additional benefit is realized from the increase in driving force (differential water vapor pressures) between the flue gases and the cooling water in the separation membrane due to the increase in flue gas dew point, which increases the transport rate of water through the separation membrane and, in turn, increases the amount of water that is reclaimed from the flue gases for steam generation. Yet a further benefit is the increased heat capacity of the combustion air, which reduces the peak flame temperature in the fluid heater vessel, thereby reducing thermal $NO_x$ formation in the fluid heater vessel.

Figure 6:
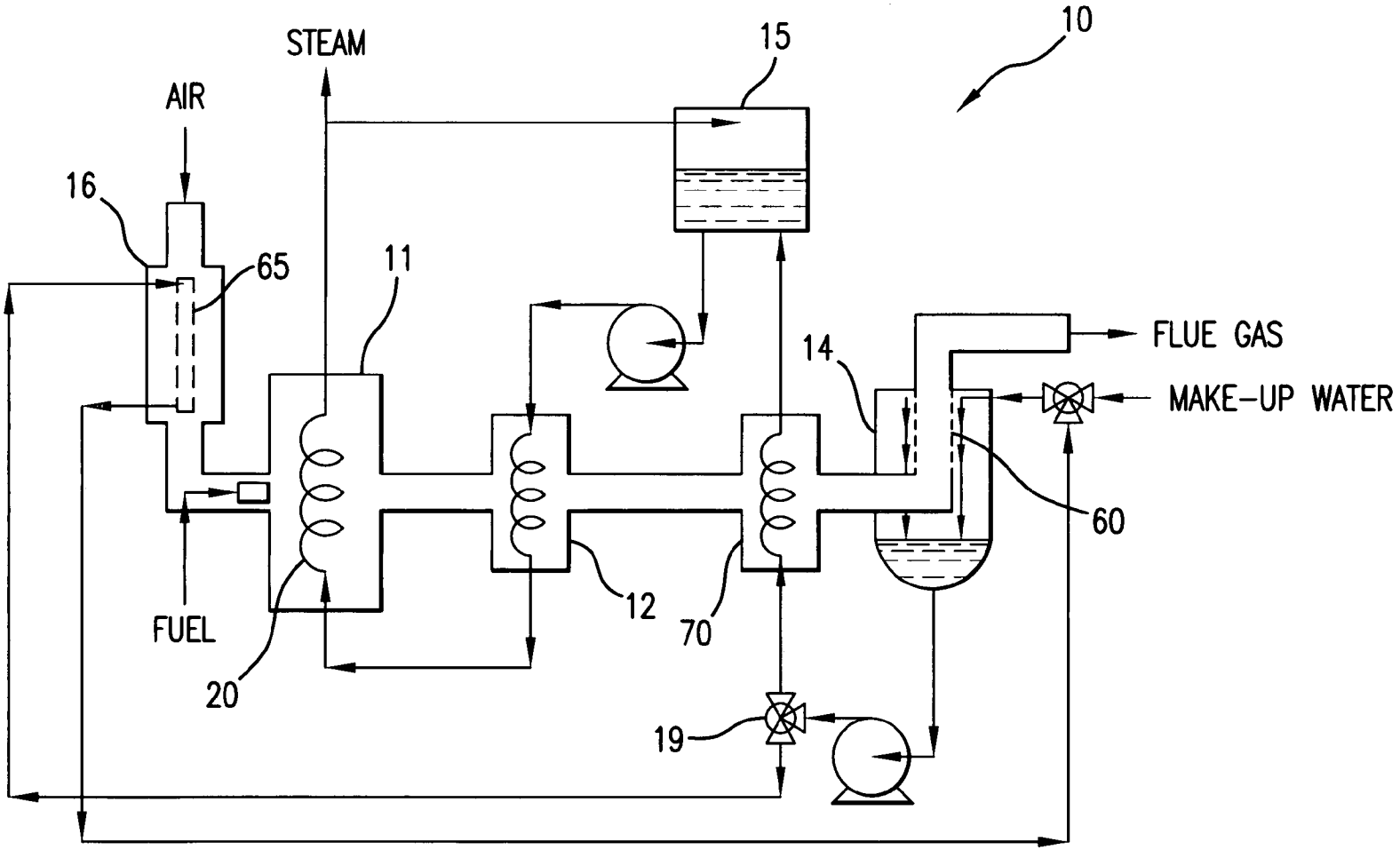
FIG. 6 is a schematic diagram of a steam generator system in accordance with still another embodiment of this invention.

A further preferred embodiment is shown in FIG. 6 in which a second economizer section 70 is incorporated downstream of the first economizer section 12. The purpose of the second economizer section is to facilitate a closer thermal approach between the flue gases and the boiler feed water, reducing the temperature of the flue gases and, thus, increasing the energy efficiency of the system. Because of the lower temperature and pressure of the second economizer section, it is not necessary for the water to be de-aerated before passing through it. The heated water exiting the second economizer section is directed to the de-aerator for conditioning before it is pumped up to boiler pressure.

The method for heating in accordance with one embodiment of this invention comprises burning a mixture of fuel and preheated oxidant in a fluid heater vessel, forming flue gases and heat. The flue gases are passed into a first economizer element downstream of the fluid heater vessel, removing a first portion of the heat and producing reduced temperature flue gases. The reduced temperature flue gases are passed from the first economizer element into a condenser element, condensing water vapor in the reduced temperature flue gases with reduced latent heat content, and forming a condensate and further reduced temperature flue gases. The further reduced temperature flue gases are exhausted from the condenser element. A first portion of the condensate is passed into an oxidant preheater, forming the preheated oxidant and a reduced temperature condensate. A second portion of the condensate is passed into a de-aerator vessel containing a first portion of steam. The first portion of steam is condensed to form condensed steam which is mixed with the second portion of the condensate to form a condensed steam and condensate mixture. The condensed steam and condensate mixture is raised in pressure and passed into the first economizer element, whereby the condensed steam and condensate mixture is heated by the first portion of the heat, forming a heated condensed steam and condensate mixture. The heated condensed steam and condensate mixture is passed into the fluid heater vessel, further heating the already heated condensed steam and condensate mixture to form steam. The reduced temperature condensate is passed into the condenser element, forming a further reduced temperature condensate, which further reduced temperature condensate is mixed with the condensate. The preferred temperature of the flue gas stream exiting the first economizer element and entering the condenser element is in the range of about 5° F. to about 15° F. above the flue gas dew point. For example, if the flue gas stream dew point is 136° F., the flue gases entering the condenser should have a temperature in the range of about 141° F. to about 151° F. for maximum effectiveness.

The position of proportioning valve 19 is controlled by the boiler control system so as to provide a flow of water passing from the valve to the de-aerator equal to the steam demand of the boiler. The remainder of the water stream exiting the pump 30 is passed entirely to the oxidant preheater 16 for cooling and recycle to condenser section 14. In the embodiment of the apparatus of this invention shown in FIG. 3, the quantity of this stream is limited only by the size of the pump, transfer lines and pressure drops deemed desirable by the system operator. Typically, the volume of this recycle stream is dictated primarily by economic considerations. From a technical standpoint, efficiency increases with increasing water flow because more heat and water vapor are removed from the flue gases. In the embodiment of the invention shown in FIG. 4, the preferred recycled water stream flow rate is between a minimum that is dictated by the surface area of the separation membrane such that the entire surface is wetted and a maximum that is dictated by the pressure drop across that portion of the heating system that distributes water across the surface of the separation membrane. The preferred range of recycle water flow is from about 25% to about 75% of the boiler steam demand. In the embodiment of this invention shown in FIG. 5, the mass flow rate of the recycle water loop is similarly constrained, with the additional constraint that the pressure in the loop must be maintained such that the water transport through the separation membrane 60 is in a range whereby the humidity of the combustion oxidant exiting the oxidant preheater 16 is maintained in the range of about 50% to about 80%. The preferred range of combustion oxidant temperatures exiting the oxidant preheater 16 is about 100° F. to about 150° F.

Figure 7:
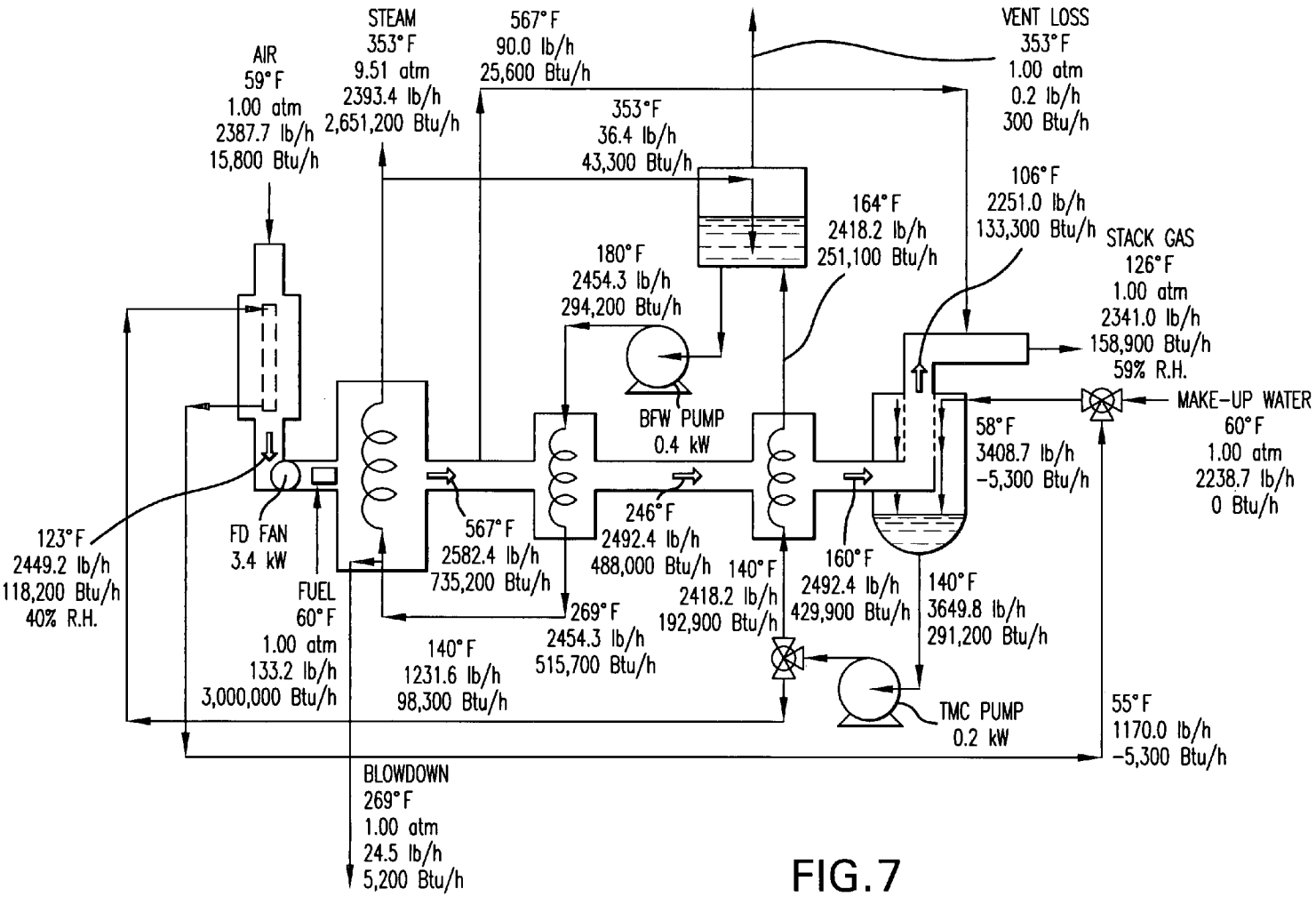
FIG. 7 is a schematic diagram showing an exemplary heat and mass balance for the system and method of this invention.

FIG. 7 sets forth a specific example of this invention where the heat management system shown in FIG. 6 is integrated with a natural gas-fired boiler. This example has been calculated using a heat and mass balance spreadsheet. The fuel is natural gas (93.7 mol percent $CH_4$, 2.8 mol percent $C_2H_6$, 0.6 mol percent $C_3H_8$, 2.0 mol percent $N_2$ and 0.9 mol percent $CO_2$) and the oxidant is air at ISO conditions (60 percent relative humidity at 59° F. at sea level, composition of 77.288 mol percent $N_2$, 20.733 mol percent $O_2$, 0.924 mol percent Ar, 0.033 mol percent $CO_2$, and 1.022 mol percent $H_2O$). Other conditions:

| | |
|---|---|
| Nominal firing rate = | 3.000 million Btu/h |
| Excess oxidant = | 10.0 percent of amount required for stoichiometric combustion |
| Standard temperature = | 60° F. |
| Standard pressure = | 1.000 atmospheres |
| Steam pressure = | 125.0 psig |
| De-aerator vent loss = | 0.01 percent by weight of steam output |
| Blowdown loss = | 1.00 percent by weight of feed water input |

Heat and mass balance data are shown in FIG. 7. The calculated energy efficiency of the system is 94.5 percent. Typically, steam boilers cannot be operated at efficiencies above about 88 percent without flue gas condensation. With condensing economizers, boilers can be operated up to about 91 percent energy efficiency. The unique combination of condensing heat exchange means, separation membrane, and humidifying oxidant preheater in accordance with the system of this invention provides the potential for maximum recovery of sensible and latent heat from the flue gas moisture and recovery of additional water for steam generation.

In the system, 2387.7 lb/h of combustion air at 59° F. and 60% relative humidity passes through humidifying oxidant heater elements 65, increasing its temperature to about 123° F. and its humidity by 61.5 lbs of added water vapor. 133.2 lb/h of natural gas is combusted with the preheated, humidified combustion air. Combustion occurs inside fluid heater vessel 11, generating 2429.8 lb/h of 125.0-psig saturated steam, and the flue gases exhaust from the fluid heater vessel at 567° F. First economizer section 12 cools the flue gases to about 246° F. while heating high pressure boiler feed water from about 180° F. to about 269° F. The flue gases are further cooled to about 160° F. in second economizer section 70, where low pressure water from condenser section 14 is preheated from about 140° F. to about 164° F. The low-pressure water stream passes to de-aerator 15, where it is exposed to about 36.4 lb/h of 353° F. saturated steam from the boiler output. In this way, dissolved gases, including $O_2$ and $CO_2$ that pass through the separation membrane along with the flue gas moisture are separated from the feed water and vented to the atmosphere. The flue gases then pass through an array of separation membrane elements 60, whereby a portion of its water vapor passes through micropores of the membrane inner surface and condenses either within the membrane structure or on the opposite side of the membrane. There the condensed water mixes with cooler water from the combined water streams from the humidifying oxidant preheater 16 and make-up water stream. This removal of water vapor and cooling of the remaining flue gases results in a cooled flue gas stream at about 106° F. and about 94% relative humidity. A portion, about 90.0 lb/h, of the hot flue gases exiting the fluid heater vessel is added to the cooled flue gas stream to raise its temperature to about 126° F. and lower its relative humidity to about 59%.

Inside condenser section 14, the combined water from make-up water, recycled water from the humidifying oxidant preheater, and water extracted from the flue gases through the separation membrane elements is collected, amounting to about 3649.8 lb/h of water at about 140° F. This water is pumped out of condenser section 14 by the pump 30 and divided into two streams by proportioning valve 19. One stream, totaling about 2418.2 lb/h, is directed to the low temperature second economizer section 70 and the other stream, totaling about 1231.6 lb/h, is directed towards humidifying oxidant preheater elements 65 where it is exposed to combustion air passing over the preheater membrane elements, from which about 61.5 lbs of water evaporates into the combustion air stream. The de-aerated feed water exiting de-aerator 15, in the amount of about 2454.3 lb/h at 180° F., is then pressurized to a pressure greater than about 125 psig and directed to first economizer section 12, whereby it increases in temperature to about 269° F. This feed water then supplies the boiler. A portion, about 24.5 lb/h, of the 353° F. feed water is discharged to drain as continuous blowdown. Likewise, a portion of about 0.2 lb/h of steam is exhausted from the de-aerator to maintain a suitable vessel pressure.

The total energy input to the system, excluding electrical power to fans and pumps, is about 3,015,600 Btu/h, and the energy output is about 2,851,200 Btu/h as saturated steam. Losses from blowdown and de-aerator vent loss are both considered in this calculation, but surface radiant losses are not included. This results in a theoretical energy efficiency of about 94.5%, which is a significant improvement over the highest available energy efficiency obtainable from a boiler without this invention, which is 91.0% based upon a conventional condensing economizer, based upon the same assumptions about steam properties, input stream properties, and losses.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A heating system comprising:

a fluid heater vessel having a fuel inlet, an oxidant inlet and flue gas exhaust means for exhausting flue gases from said fluid heater vessel, said flue gas exhaust means comprising a first economizer section downstream of said fluid heater vessel and a condenser section disposed downstream of said first economizer section, said condenser section having a condensate outlet;

an oxidant preheater having an ambient oxidant inlet and a heated oxidant outlet, said heated oxidant outlet in fluid communication with said oxidant inlet;

a first fluid heat exchange means disposed in thermal communication with said fluid heater vessel, a second fluid heat exchange means disposed in thermal communication with said first economizer section, a third fluid heat exchange means disposed in thermal communication with said oxidant preheater, and condenser means for condensing flue gas water vapor, said condenser means disposed within said condenser section;

one of a feed water tank and a de-aerator vessel; and fluid communication means for providing fluid communication from said condenser means into said third fluid heat exchange means, from said condensate outlet into said third fluid heat exchange means, from said third fluid heat exchange means into said condenser means, from said condenser outlet and said condenser means into said one of said feed water tank and said de-aerator vessel, from said one of said feed water tank and said de-aerator vessel into said second fluid heat exchange means, from said second fluid heat exchange means into said first fluid heat exchange means, and from said first fluid heat exchange means into said one of said feed water tank and said de-aerator vessel.

2. A heating system in accordance with claim 1, wherein said fluid communication means comprises a condensate mixing valve disposed downstream of said condenser means and having a condensate inlet in fluid communication with said condensate outlet, a heat exchange fluid inlet in communication with said condenser means, and a mixed fluid outlet in fluid communication with said third fluid heat exchange means.

3. A heating system in accordance with claim 2, wherein said fluid communication means further comprises a proportioning valve having a mixed fluid inlet in fluid communication with said mixed fluid outlet, a first proportioning valve outlet in fluid communication with said de-aerator vessel, and a second proportioning valve outlet in fluid communication with said third fluid heat exchange means.

4. A heating system in accordance with claim 1, wherein said condenser means comprises a direct surface condenser element.

5. A heating system in accordance with claim 1, wherein said condenser means comprises at least one separation membrane element.

6. A heating system in accordance with claim 5, wherein said at least one separation membrane element comprises at least one permselective membrane, said at least one permselective membrane adapted to selectively pass flue gas water vapor therethrough.

7. A heating system in accordance with claim 1, wherein said third fluid heat exchange means comprises humidification means for humidifying oxidant in said oxidant preheater.

8. A heating system in accordance with claim 7, wherein said humidification means comprises at least one water permeable membrane.

9. A heating system in accordance with claim 1, wherein said flue gas exhaust means comprises a second economizer section disposed between, and in fluid communication with, said first economizer section and said condenser section.

10. A heating method comprising:

burning a mixture of fuel and preheated oxidant in a fluid heater vessel, forming flue gases and heat;

passing said flue gases into a first economizer element downstream of said fluid heater vessel, removing a first portion of said heat and producing reduced temperature flue gases;

passing said reduced temperature flue gases from said first economizer element into a condenser element, condensing water vapor in said reduced temperature flue gases, forming a condensate and further reduced temperature flue gases;

exhausting said further reduced temperature flue gases from said condenser element;

passing a first portion of said condensate into an oxidant preheater, forming said preheated oxidant and a reduced temperature condensate;

passing a second portion of said condensate into a de-aerator vessel containing a first portion of steam, condensing said first portion of steam to form condensed steam and mixing said condensed steam with said second portion of said condensate to form a condensed steam and condensate mixture;

passing said condensed steam and condensate mixture into said first economizer element, whereby said condensed steam and condensate mixture is heated by said first portion of said heat, forming a heated condensed steam and condensate mixture;

passing said heated condensed steam and condensate mixture into at least one heat exchange means in thermal communication with said fluid heater vessel, heating said heated condensed steam and condensate mixture to form one of steam and hot water;

passing said reduced temperature condensate into said condenser element, forming a further reduced temperature condensate; and mixing said further reduced temperature condensate with said condensate.

11. A heating method in accordance with claim 10, wherein said condensed water vapor is formed by passing water vapor in said flue gases through a permselective membrane disposed within said condenser element.

12. A heating method in accordance with claim 10, wherein a portion of said first portion of said condensate is mixed with oxidant in said oxidant preheater, humidifying said preheated oxidant.

13. A heating method in accordance with claim 10, wherein said second portion of said condensate is passed through a second economizer element and said condenser element prior to passing into said de-aerator vessel, preheating said second portion of said condensate.

* * * * *